US009484192B2

(12) United States Patent
Chapman et al.

(10) Patent No.: US 9,484,192 B2
(45) Date of Patent: Nov. 1, 2016

(54) DATA DIRECTED STORAGE OF IMAGING MASS SPECTRA

(71) Applicant: Micromass UK Limited, Wilmslow (GB)

(72) Inventors: Richard Chapman, Runcorn (GB); Jeffery Mark Brown, Hyde (GB); Paul Murray, Manchester (GB); Keith Richardson, Derbyshire (GB); Emmy Maria Hoyes, Mellor (GB)

(73) Assignee: Micromass UK Limited, Wilmslow (GB)

( * ) Notice: Subject to any disclaimer, the term of this patent is extended or adjusted under 35 U.S.C. 154(b) by 0 days.

(21) Appl. No.: 14/776,036

(22) PCT Filed: Mar. 14, 2014

(86) PCT No.: PCT/GB2014/050807

§ 371 (c)(1),
(2) Date: Sep. 14, 2015

(87) PCT Pub. No.: WO2014/140627

PCT Pub. Date: Sep. 18, 2014

(65) Prior Publication Data

US 2016/0027626 A1 Jan. 28, 2016

(30) Foreign Application Priority Data

Mar. 15, 2013 (EP) ..... 13159564
Mar. 15, 2013 (GB) ..... 1304751.9

(51) Int. Cl.
*H01J 49/00* (2006.01)

(52) U.S. Cl.
CPC ..... *H01J 49/0004* (2013.01); *H01J 49/0031* (2013.01); *H01J 49/0036* (2013.01)

(58) Field of Classification Search
USPC ..... 250/281, 282
See application file for complete search history.

(56) References Cited

U.S. PATENT DOCUMENTS

| | | | | |
|---|---|---|---|---|
| 7,655,476 | B2 | 2/2010 | Bui | |
| 2004/0183006 | A1 | 9/2004 | Reilly et al. | |
| 2004/0183009 | A1 | 9/2004 | Reilly et al. | |
| 2007/0284521 | A1 * | 12/2007 | Green | H01J 49/06 250/283 |
| 2011/0172115 | A1 | 7/2011 | Thompson | |
| 2013/0131998 | A1 * | 5/2013 | Wright | G06F 19/703 702/27 |

OTHER PUBLICATIONS

Stoeckli et al., "*Automated Mass Spectrometry Imaging with a Matrix-Assisted Laser Desorption Ionization Time-of-Flight Instrument—Localization of Peptides and Proteins Using MALDI-TOF MS*", Journal of the American Society for Mass Spectrometry, vol. 10, No. 1, pp. 67-71, 1999.

* cited by examiner

*Primary Examiner* — Kiet T Nguyen
(74) *Attorney, Agent, or Firm* — Diederiks & Whitelaw, PLC

(57) ABSTRACT

A method of ion imaging is disclosed comprising scanning a sample and acquiring first mass spectral data related to a first pixel location at a first spatial resolution and determining whether or not the first mass spectral data satisfies a condition. If it is determined that the first mass spectral data does satisfy the condition then the first mass spectral data is stored, recorded or prioritized. If it is determined that the first mass spectral data does not satisfy the condition then the first mass spectral data is discarded or downgraded. Scanning of the sample then continues at the first spatial resolution and further mass spectral data related to further pixel locations is acquired.

14 Claims, 3 Drawing Sheets

DATA DIRECTED STORAGE OF IMAGING MASS SPECTRA

CROSS-REFERENCE TO RELATED APPLICATION

This application is the National Stage of International Application No. PCT/GB2014/050807, filed 14 Mar. 2014 which claims priority from and the benefit of United Kingdom patent application No. 1304751.9 filed on 15 Mar. 2013 and European patent application No. 13159564.7 filed 15 Mar. 2013. The entire contents of these applications are incorporated herein by reference.

BACKGROUND OF THE PRESENT INVENTION

The present invention relates to a method of ion imaging and a mass spectrometer.

It is known to perform ion imaging wherein a plurality of mass spectral data is acquired across the surface of a sample at different pixel locations.

During an imaging mass spectral acquisition MS, MS/MS or ion mobility-MS data is acquired from an array of previously defined pixel locations from a target. The number of pixels required to generate an image can result in very large file sizes particularly when the spectra cover a large mass range.

U.S. Pat. No. 7,655,476 (Bui) discloses an arrangement for reducing the scan time in imaging mass spectrometry.

An automated use of a Matrix Assisted Laser Desorption Ionisation ("MALDI") mass spectrometer is disclosed in M. Stoeckli, T. Farmer and R. Caprioli "Automated Mass Spectrometry Imaging with a Matrix-Assisted Laser Desorption Ionization Time-of-Flight Instrument" J. Am. Soc. Mass Spectrom. 1999, p. 67-71 which will be referred to hereinafter as "Stoeckli".

It is desired to provide an improved method of ion imaging.

SUMMARY OF THE PRESENT INVENTION

According to an aspect of the present invention there is provided a method of ion imaging comprising:

scanning a sample and acquiring first mass spectral data related to a first pixel location at a first spatial resolution;

determining whether or not the first mass spectral data satisfies a condition, wherein if it is determined that the first mass spectral data does satisfy the condition then the first mass spectral data is stored, recorded or prioritised and wherein if it is determined that the first mass spectral data does not satisfy said condition then the first mass spectral data is discarded or downgraded; and then continuing to scan the sample at the first spatial resolution and acquiring further mass spectral data related to further pixel locations.

FIGS. 9-11 of U.S. Pat. No. 7,655,476 (Bui) discloses an arrangement wherein target areas are randomly distributed across an area to be imaged. A first imaging scan is then performed at low resolution by sequentially irradiating each of the target areas.

All the low resolution data is then analysed to identify one or more areas of interest. High resolution target regions are then disposed within the areas of interest and are arranged to fill in areas of interest as shown in FIG. 11 of U.S. Pat. No. 7,655,476 (Bui).

It should be noted that the present invention scans a sample at a constant or fixed resolution. If ions of interest are determined to be present at a certain pixel location then the mass spectral data is saved, otherwise the mass spectral data is discarded. Irrespective of whether or not mass spectral data relating a pixel is saved or discarded the scanning process continues on to the next pixel without changing the spatial resolution.

In contrast to the present invention the approach disclosed in U.S. Pat. No. 7,655,476 (Bui) does not discard low resolution mass spectral data during acquisition. Instead, the approach disclosed in U.S. Pat. No. 7,655,476 (Bui) acquires mass spectral data across the whole of a sample without discarding mass spectral data during acquisition.

The present invention is particularly advantageous in that in contrast to the approach disclosed in U.S. Pat. No. 7,655,476 (Bui) the mass spectrometer does not retain and then process a large volume of mass spectral data, a large proportion of which may comprise mass spectral data which is not of interest. Instead, according to the present invention mass spectral data which is determined during acquisition not to be of interest is discarded before a scan is completed.

It will be apparent, therefore, that the present invention is particularly advantageous compared with the approach as disclosed, for example, in U.S. Pat. No. 7,655,476 (Bui).

Stoeckli discloses with reference to FIG. 1 setting up initial image parameters at a time $t_i$, firing the laser and acquiring data, moving the target on to the next spot and firing the laser again using the same initial image parameters.

Stoeckli does not disclose determining whether or not mass spectral data satisfies a condition, wherein if it is determined that the mass spectral data does satisfy the condition then the mass spectral data is stored, recorded or prioritised and wherein if it is determined that the mass spectral data does not satisfy said condition then the mass spectral data is discarded or downgraded.

The preferred embodiment relates to a method of determining whether a spectrum acquired from or relating to a pixel location contains information of interest, in order to reduce data sets to only relevant information.

When screening a tissue section for ions having a known mass to charge ratio and/or ion mobility, the method according to the preferred embodiment seeks to identify the locality of ion(s) of interest. In this case, only spectra with ions of interest are of any relevance.

An inclusion condition is introduced wherein spectra are only recorded for pixels with an intensity above a defined threshold at the relevant mass to charge ratio. This approach has the potential to significantly reduce the size of the data.

According to the preferred embodiment all other spectra from other locations are removed or reduced to place holders with no spectral content.

Conventional mass spectrometers do not reduce spectral content to reduce file sizes in this manner.

The size of ion imaging data sets can result in long processing times and long times for transferring data for further processing. Reduction in the data sizes during acquisition to only spectra that contain relevant information can according to the preferred embodiment significantly reduce the time taken to handle the data sets and generate ion images that can be interrogated for specific ions.

The conditional determination of what are considered relevant spectra may be used to determine regions of interest rather than the localities of specific ions of interest.

Since acquisition time and image processing can be such time demanding processes, an experiment may be configured so as to minimize the area analyzed by the user defining a marked region. The use of this technique allows the present method to determine a region of interest based on the ion fingerprint and can refine the area over which data is stored allowing a user to be less refined in defining the regions of interest.

The step of determining whether or not the first mass spectral data satisfies the condition preferably comprises determining whether or not the first mass spectral data includes: (i) ions having an intensity above a threshold; (ii) ions having one or more mass to charge ratios of interest; (iii) ions having one or more mass to charge ratios of interest and an intensity above a threshold; (iv) ions having one or more ion mobilities of interest; or (v) ions having one or more ion mobilities of interest and an intensity above a threshold.

The step of determining whether or not the first mass spectral data satisfies the condition is preferably performed during an acquisition.

The step of determining whether or not the first mass spectral data satisfies the condition may alternatively be performed as a post-processing step.

The method preferably further comprises:

continuing to scan the sample at the first spatial resolution and acquiring second mass spectral data related to a second pixel location;

determining whether or not the second mass spectral data satisfies the condition, wherein if it is determined that the second mass spectral data does satisfy the condition then the second mass spectral data is stored, recorded or prioritised and wherein if it is determined that the second mass spectral data does not satisfy the condition then the second mass spectral data is discarded or downgraded; and then continuing to scan the sample at the first spatial resolution and acquiring further mass spectral data related to further pixel locations.

The method preferably further comprises:

continuing to scan the sample at the first spatial resolution and acquiring third mass spectral data related to a third pixel location;

determining whether or not the third mass spectral data satisfies the condition, wherein if it is determined that the third mass spectral data does satisfy the condition then the third mass spectral data is stored, recorded or prioritised and wherein if it is determined that the third mass spectral data does not satisfy the condition then the third mass spectral data is discarded or downgraded; and then continuing to scan the sample at the first spatial resolution and acquiring further mass spectral data related to further pixel locations.

According to another aspect of the present invention there is provided a mass spectrometer comprising:

a control system arranged and adapted:

(i) to scan a sample and acquire first mass spectral data related to a first pixel location at a first spatial resolution;

(ii) to determine whether or not the first mass spectral data satisfies a condition, wherein if it is determined that the first mass spectral data does satisfy the condition then the first mass spectral data is stored, recorded or prioritised and wherein if it is determined that the first mass spectral data does not satisfy the condition then the first mass spectral data is discarded or downgraded; and then (iii) to continue to scan the sample at the first spatial resolution and to acquire further mass spectral data related to further pixel locations.

The control system is preferably further arranged and adapted to determine whether or not the first mass spectral data satisfies the condition by determining whether or not the first mass spectral data includes: (i) ions having an intensity above a threshold; (ii) ions having one or more mass to charge ratios of interest; (iii) ions having one or more mass to charge ratios of interest and an intensity above a threshold; (iv) ions having one or more ion mobilities of interest; or (v) ions having one or more ion mobilities of interest and an intensity above a threshold.

The control system is preferably further arranged and adapted:

(i) to continue to scan the sample and acquire second mass spectral data related to a second pixel location at the first spatial resolution;

(ii) to determine whether or not the second mass spectral data satisfies a condition, wherein if it is determined that the second mass spectral data does satisfy the condition then the second mass spectral data is stored, recorded or prioritised and wherein if it is determined that the second mass spectral data does not satisfy the condition then the second mass spectral data is discarded or downgraded; and then (iii) to continue to scan the sample at the first spatial resolution and to acquire further mass spectral data related to further pixel locations.

The control system is preferably further arranged and adapted:

(i) to continue to scan the sample and acquire third mass spectral data related to a third pixel location at the first spatial resolution;

(ii) to determine whether or not the third mass spectral data satisfies a condition, wherein if it is determined that the third mass spectral data does satisfy the condition then the third mass spectral data is stored, recorded or prioritised and wherein if it is determined that the third mass spectral data does not satisfy the condition then the third mass spectral data is discarded or downgraded; and then (iii) to continue to scan the sample at the first spatial resolution and to acquire further mass spectral data related to further pixel locations.

According to another aspect of the present invention there is provided a method of ion imaging comprising:

(i) obtaining mass spectral data corresponding to a pixel location at a first spatial resolution;

(ii) determining whether or not the mass spectral data passes or fails a criterion and either: (a) discarding the mass spectral data if the mass spectral data fails the criterion; and/or (b) storing the mass spectral data and optionally the coordinates of the pixel location if the mass spectral data passes the criterion; and repeating steps (i) and (ii) a plurality of times.

According to another aspect of the present invention there is provided a mass spectrometer comprising a control system arranged and adapted:

(i) to obtain mass spectral data corresponding to a pixel location at a first spatial resolution;

(ii) to determine whether or not the mass spectral data passes or fails a criterion and either: (a) discarding the mass spectral data if the mass spectral data fails the criterion; and/or (b) storing the mass spectral data and optionally the coordinates of the pixel location if the mass spectral data passes the criterion; and (iii) to repeat steps (i) and (ii) a plurality of times.

According to another aspect of the present invention there is provided a method of ion imaging comprising:

determining whether or not mass spectral data corresponding to a pixel location or a surrounding region comprises ions of interest; and discarding the mass spectral data before having completed an initial scan if the mass spectral data is determined not to comprise ions of interest.

According to another aspect of the present invention there is provided a mass spectrometer comprising:

a control system arranged and adapted:

(i) to determine whether or not mass spectral data corresponding to a pixel location or a surrounding region comprises ions of interest; and (ii) to discard the mass spectral data before having completed an initial scan if the mass spectral data is determined not to comprise ions of interest.

According to an embodiment the mass spectrometer may further comprise:

(a) an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; (xxvi) a Solvent Assisted Inlet Ionisation ("SAII") ion source; (xxvii) a Desorption Electrospray Ionisation ("DESI") ion source; and (xxviii) a Laser Ablation Electrospray Ionisation ("LAESI") ion source; and/or (b) one or more continuous or pulsed ion sources; and/or (c) one or more ion guides; and/or (d) one or more ion mobility separation devices and/or one or more Field Asymmetric Ion Mobility Spectrometer devices; and/or (e) one or more ion traps or one or more ion trapping regions; and/or (f) one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device; and/or (g) a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic mass analyser arranged to generate an electrostatic field having a quadro-logarithmic potential distribution; (x) a Fourier Transform electrostatic mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser; and/or (h) one or more energy analysers or electrostatic energy analysers; and/or (i) one or more ion detectors; and/or (j) one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wien filter; and/or (k) a device or ion gate for pulsing ions; and/or (l) a device for converting a substantially continuous ion beam into a pulsed ion beam.

The mass spectrometer may further comprise either:

(i) a C-trap and a mass analyser comprising an outer barrel-like electrode and a coaxial inner spindle-like electrode that form an electrostatic field with a quadro-logarithmic potential distribution, wherein in a first mode of operation ions are transmitted to the C-trap and are then injected into the mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the mass analyser; and/or (ii) a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

According to an embodiment the mass spectrometer further comprises a device arranged and adapted to supply an AC or RF voltage to the electrodes. The AC or RF voltage preferably has an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak.

The AC or RF voltage preferably has a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

The mass spectrometer may also comprise a chromatography or other separation device upstream of an ion source. According to an embodiment the chromatography separation device comprises a liquid chromatography or gas chromatography device. According to another embodiment the separation device may comprise: (i) a Capillary Electrophoresis ("CE") separation device; (ii) a Capillary Electrochromatography ("CEC") separation device; (iii) a substantially rigid ceramic-based multilayer microfluidic substrate ("ceramic tile") separation device; or (iv) a supercritical fluid chromatography separation device.

The ion guide is preferably maintained at a pressure selected from the group consisting of: (i) <0.0001 mbar; (ii) 0.0001-0.001 mbar; (iii) 0.001-0.01 mbar; (iv) 0.01-0.1 mbar; (v) 0.1-1 mbar; (vi) 1-10 mbar; (vii) 10-100 mbar; (viii) 100-1000 mbar; and (ix) >1000 mbar.

BRIEF DESCRIPTION OF THE DRAWINGS

Various embodiments of the present invention will now be described, by way of example only, and with reference to the accompanying drawings in which.

DETAILED DESCRIPTION OF PREFERRED EMBODIMENTS

A preferred embodiment of the present invention will now be described.

When performing an ion imaging experiment the amount of data generated can be excessive making it slow to process. The preferred embodiment seeks to reduce the amount of data generated during or after an imaging mass spectral acquisition by limiting the recorded spectra to pixels where the intensity of an ion of interest exceeds a defined threshold or other defined criteria so as to speed up post acquisition image processing.

Figure 1:
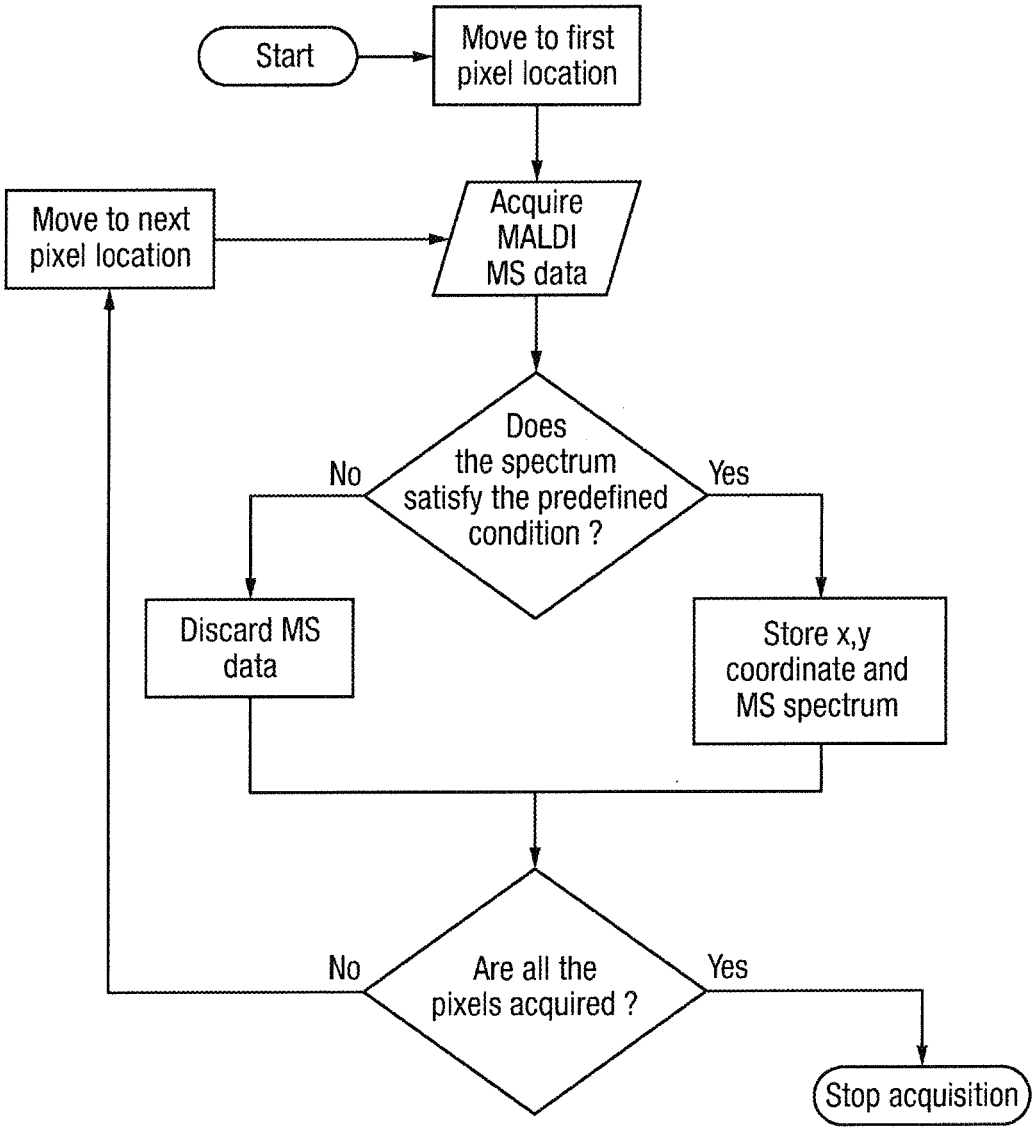
FIG. 1 shows an experimental work flow according to an embodiment of the present invention.

An experimental workflow after defining an area to be imaged and setting a pixel resolution is outlined in FIG. 1.

This approach can be applied to data acquired on any Matrix Assisted Laser Desorption Ionisation ("MALDI") mass spectrometer and various other types of mass spectrometers, and can be employed either during an acquisition or on a previously acquired ion imaging data set in order to produce a second reduced data set for further ion image processing.

In a post-processing approach the workflow is substantially similar to that shown in FIG. 1 except that instead of acquiring data from a pixel, each previously acquired spectrum is interrogated to determine a pass or fail according to the pre-defined condition. In the case of a pass the spectrum and preferably the coordinate(s) is saved. In the event of a fail the spectrum is preferably discarded. The final raw data set generated therefore preferably only comprises regions of interest.

By retaining the full spectral content of pixels identified as being of interest other co-localised species can be analysed.

Figure 2:
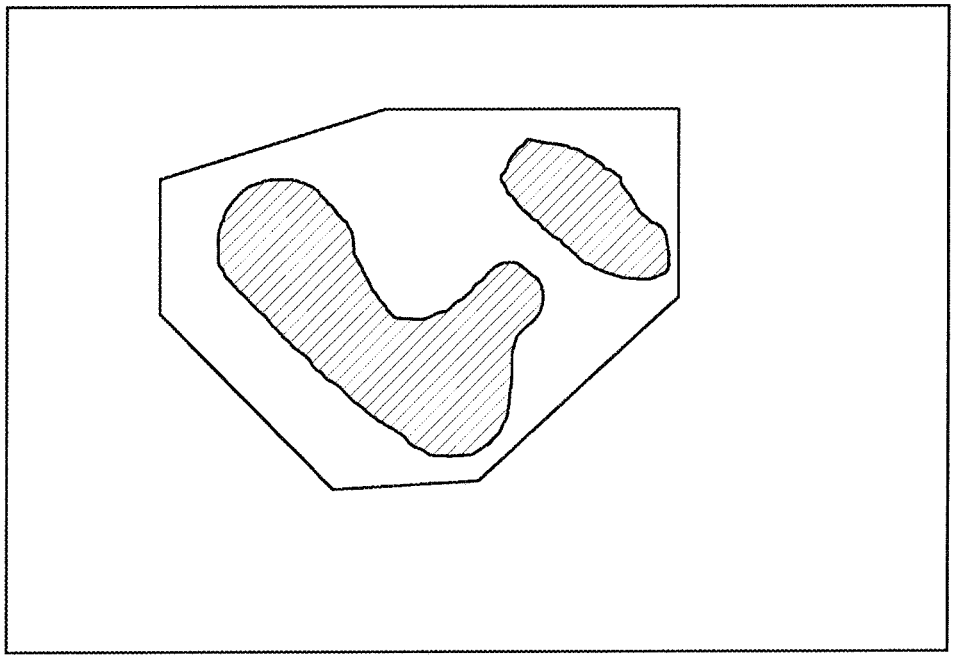
FIG. 2 shows an image of a sample plate with a sample mounted thereon and two regions of interest (shaded)

FIG. 2 shows an image of a sample plate with a sample mounted thereon and shows a user defined region to be analysed (light shading) and two regions of interest (dark shading).

Figure 3:
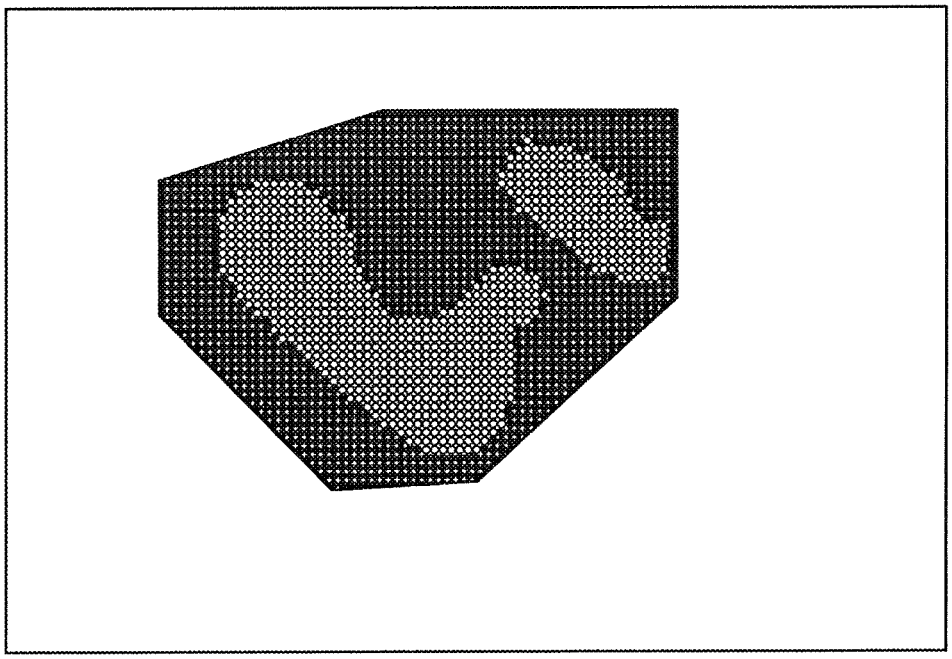
FIG. 3 shows pixels wherein MS acquisition is performed and shows pixels which have failed and pixels which have passed a condition according to predefined conditions.

FIG. 3 shows pixels where MS acquisition is performed with dark shading indicating a fail condition and light shading indicating a pass condition according to predefined conditions.

Figure 4:
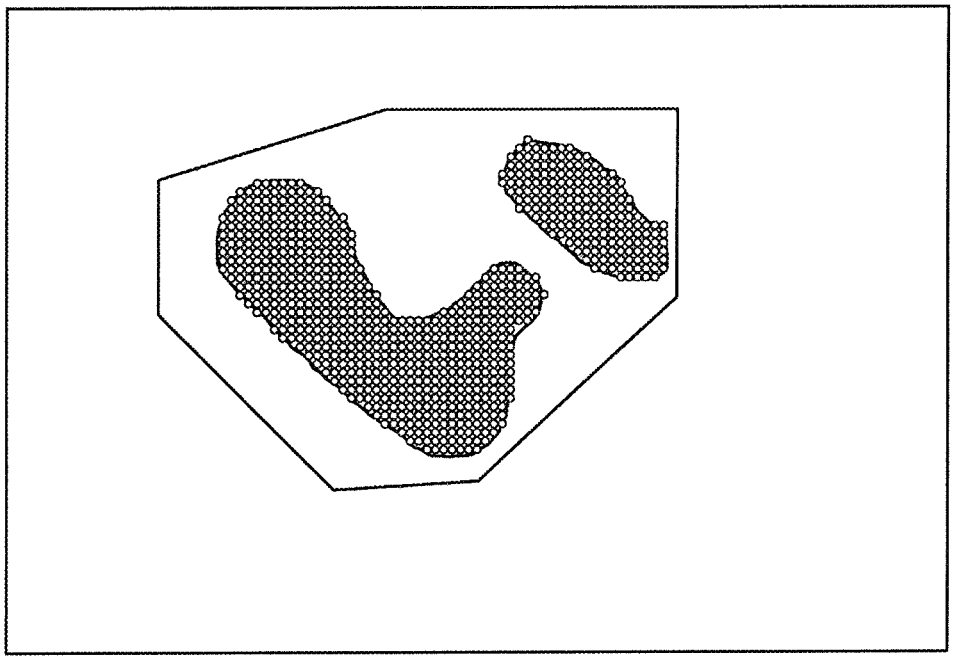
FIG. 4 shows pixels with stored mass spectral data relating to two regions of interest.

FIG. 4 shows pixels with stored mass spectral data identifying two regions of interest.

Figure 5:
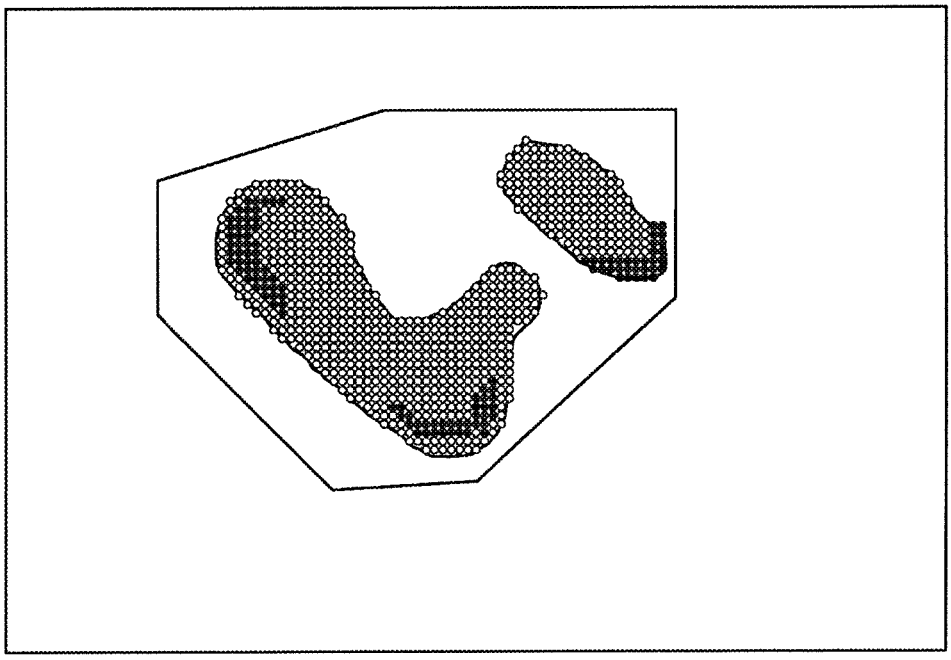
FIG. 5 shows an ion image of the two regions of interest and shows the specific location of particular ions of interest within the regions of interest.

FIG. 5 shows an ion image of the regions of interest and shows the location of particular ions of interest within the regions of interest.

Various alternative embodiments are contemplated.

The data sets may comprise MS imaging data, MS/MS imaging data or ion mobility separated MS or MS/MS imaging data.

The condition for storing a spectra may be a simple threshold intensity of a particular mass to charge ratio or a number of predefined mass to charge ratio intensity thresholds may be utilised. The preferred approach may also employ a Principle Component Analysis ("PCA") approach to determine whether the spectrum is of relevance or a database search (e.g. MASCOT) to determine a MOWSE score.

The output from the preferred approach may comprise place holders defining the coordinates of the ion image and removing the spectral content from non-relevant pixel locations whilst retaining MS data and pixel coordinates of pixels determined to be significant or reducing the data to only pixel coordinates and associated spectra (or IMS MS) that are determined to be significant.

The technique can be applied to identify specific tissues or regions of interest for specific interrogation e.g. an initial identification of the locality of a particular organ in an ion image of a tissue section and then subsequently to determine the localisation of drugs or metabolites within the organ.

Although the present invention has been described with reference to preferred embodiments, it will be understood by those skilled in the art that various changes in form and detail may be made without departing from the scope of the invention as set forth in the accompanying claims.

The invention claimed is:

1. A method of ion imaging comprising:

scanning a sample and acquiring first mass spectral data related to a first pixel location at a first spatial resolution;

determining whether or not said first mass spectral data satisfies a condition, wherein if it is determined that said first mass spectral data does satisfy said condition then said first mass spectral data is stored, recorded or prioritized and wherein if it is determined that said first mass spectral data does not satisfy said condition then said first mass spectral data is discarded or downgraded; and then continuing to scan said sample at said first spatial resolution and acquiring further mass spectral data related to further pixel locations.

2. A method as claimed in claim 1, wherein the step of determining whether or not said first mass spectral data satisfies said condition comprises determining whether or not said first mass spectral data includes: (i) ions having an intensity above a threshold; (ii) ions having one or more mass to charge ratios of interest; (iii) ions having one or more mass to charge ratios of interest and an intensity above a threshold; (iv) ions having one or more ion mobilities of interest; or (v) ions having one or more ion mobilities of interest and an intensity above a threshold.

3. A method as claimed in claim 1, wherein the step of determining whether or not said first mass spectral data satisfies said condition is performed during an acquisition.

4. A method as claimed in claim 1, wherein the step of determining whether or not said first mass spectral data satisfies said condition is performed as a post-processing step.

5. A method as claimed in claim 1, further comprising:

continuing to scan said sample at said first spatial resolution and acquiring second mass spectral data related to a second pixel location;

determining whether or not said second mass spectral data satisfies said condition, wherein if it is determined that said second mass spectral data does satisfy said condition then said second mass spectral data is stored, recorded or prioritized and wherein if it is determined that said second mass spectral data does not satisfy said condition then said second mass spectral data is discarded or downgraded; and then continuing to scan said sample at said first spatial resolution and acquiring further mass spectral data related to further pixel locations.

6. A method as claimed in claim 5, further comprising:

continuing to scan said sample at said first spatial resolution and acquiring third mass spectral data related to a third pixel location;

determining whether or not said third mass spectral data satisfies said condition, wherein if it is determined that said third mass spectral data does satisfy said condition then said third mass spectral data is stored, recorded or prioritized and wherein if it is determined that said third mass spectral data does not satisfy said condition then said third mass spectral data is discarded or downgraded; and then continuing to scan said sample at said first spatial resolution and acquiring further mass spectral data related to further pixel locations.

7. A mass spectrometer comprising:

a control system arranged and adapted:

(i) to scan a sample and acquire first mass spectral data related to a first pixel location at a first spatial resolution;

(ii) to determine whether or not said first mass spectral data satisfies a condition, wherein if it is determined that said first mass spectral data does satisfy said condition then said first mass spectral data is stored, recorded or prioritized and wherein if it is determined that said first mass spectral data does not satisfy said condition then said first mass spectral data is discarded or downgraded; and then (iii) to continue to scan said sample at said first spatial resolution and to acquire further mass spectral data related to further pixel locations.

8. A mass spectrometer as claimed in claim 7, wherein said control system is further arranged and adapted to determine whether or not said first mass spectral data satisfies said condition by determining whether or not said first mass spectral data includes: (i) ions having an intensity above a threshold; (ii) ions having one or more mass to charge ratios of interest; (iii) ions having one or more mass to charge ratios of interest and an intensity above a threshold; (iv) ions having one or more ion mobilities of interest; or (v) ions having one or more ion mobilities of interest and an intensity above a threshold.

9. A mass spectrometer as claimed in claim 7, wherein said control system is further arranged and adapted:

(i) to continue to scan said sample and acquire second mass spectral data related to a second pixel location at said first spatial resolution;

(ii) to determine whether or not said second mass spectral data satisfies a condition, wherein if it is determined that said second mass spectral data does satisfy said condition then said second mass spectral data is stored, recorded or prioritized and wherein if it is determined that said second mass spectral data does not satisfy said condition then said second mass spectral data is discarded or downgraded; and then (iii) to continue to scan said sample at said first spatial resolution and to acquire further mass spectral data related to further pixel locations.

10. A mass spectrometer as claimed in claim 9, wherein said control system is further arranged and adapted:

(i) to continue to scan said sample and acquire third mass spectral data related to a third pixel location at said first spatial resolution;

(ii) to determine whether or not said third mass spectral data satisfies a condition, wherein if it is determined that said third mass spectral data does satisfy said condition then said third mass spectral data is stored, recorded or prioritized and wherein if it is determined that said third mass spectral data does not satisfy said condition then said third mass spectral data is discarded or downgraded; and then (iii) to continue to scan said sample at said first spatial resolution and to acquire further mass spectral data related to further pixel locations.

11. A method of ion imaging comprising:

(i) obtaining mass spectral data corresponding to a pixel location at a first spatial resolution;

(ii) determining whether or not said mass spectral data passes or fails a criterion and either: (a) discarding said mass spectral data if said mass spectral data fails said criterion; or (b) storing said mass spectral data and the coordinates of said pixel location if said mass spectral data passes said criterion; and repeating steps (i) and (ii) a plurality of times.

12. A mass spectrometer comprising a control system arranged and adapted:

(i) to obtain mass spectral data corresponding to a pixel location at a first spatial resolution;

(ii) to determine whether or not said mass spectral data passes or fails a criterion and either: (a) discarding said mass spectral data if said mass spectral data fails said criterion; or (b) storing said mass spectral data and the coordinates of said pixel location if said mass spectral data passes said criterion; and (iii) to repeat steps (i) and (ii) a plurality of times.

13. A method of ion imaging comprising:

determining whether or not mass spectral data corresponding to a pixel location or a surrounding region comprises ions of interest; and discarding said mass spectral data before having completed an initial scan if said mass spectral data is determined not to comprise ions of interest.

14. A mass spectrometer comprising:

a control system arranged and adapted:

(i) to determine whether or not mass spectral data corresponding to a pixel location or a surrounding region comprises ions of interest; and (ii) to discard said mass spectral data before having completed an initial scan if said mass spectral data is determined not to comprise ions of interest.

* * * * *